US005558570A

United States Patent [19]

Nakamura et al.

[11] Patent Number: 5,558,570

[45] Date of Patent: Sep. 24, 1996

[54] POWER TOOL HAVING DETACHABLE AUXILIARY HANDLE

[75] Inventors: Nobuhisa Nakamura; Kazuhide Ohzeki; Hiroshi Takano, all of Hitachinaka, Japan

[73] Assignee: Hitachi Koki Co., Ltd., Tokyo, Japan

[21] Appl. No.: 397,642

[22] Filed: Mar. 2, 1995

[30] Foreign Application Priority Data

Apr. 8, 1994 [JP] Japan ..... 6-070977

[51] Int. Cl.[6] ..... B24B 23/00

[52] U.S. Cl. ..... 451/357; 451/442; 16/114 R; 16/DIG. 19; 16/DIG. 24

[58] Field of Search ..... 451/344, 353, 451/451, 453, 456, 449, 359, 357, 442; 16/DIG. 19, DIG. 24, 114 R

[56] References Cited

U.S. PATENT DOCUMENTS 3,579,711 5/1971 Nicolin ..... 16/DIG. 24

4,577,367 3/1986 Durand ..... 16/DIG. 24

5,074,081 12/1991 Beth et al. ..... 51/170

OTHER PUBLICATIONS

"Hitachi Random Automatic Sander", Published Aug. 1994.

*Primary Examiner*—Robert A. Rose

*Attorney, Agent, or Firm*—Sughrue, Mion, Zinn, Macpeak & Seas

[57] ABSTRACT

A power tool having a detachable arrangement of an auxiliary handle relative to a main body. The main body has a handle receiving portion. The auxiliary handle has a grip portion and an insertion portion engageable with the handle receiving portion. The insertion portion extends from the grip portion and includes an upper flat surface provided with a protrusion, and a lower arcuate surface. The insertion portion also includes a resilient latch. The receiving portion is provided by a hole having a top flat surface, a lower flat surface and a bottom surface. The top flat surface is formed with an indentation engageable with the protrusion. The base end of the arcuate surface is engageable with the lower flat surface. The lower flat surface is formed with a further recess with which the resilient latch is engageable.

4 Claims, 6 Drawing Sheets

POWER TOOL HAVING DETACHABLE AUXILIARY HANDLE

BACKGROUND OF THE INVENTION

1. Field of the Invention

The present invention relates to a power tool provided with a detachable arrangement of an auxiliary handle relative to a main body of the power tool.

2. Description of the Related Art

A sander or other power tool is provided with a main handle (not shown) that is integrally attached to the main body 11 of the power tool. Additionally, the power tool is provided with the detachable auxiliary handle 1 shown in FIG. 1. The auxiliary handle 1 includes a grip 2, an insertion portion 3, and a latch 4. As shown in FIG. 2, the latch 4 includes a claw 4a with a slanted surface 4*b* and a ridged portion 4c. The latch 4 is formed substantially V-shaped in cross-section so that the latch 4 is resiliently deformable.

As shown in FIG. 2, the main body 11 of the power tool has an insertion hole 12 for receiving the auxiliary handle 1. To facilitate insertion of the insertion portion 3 into the insertion hole 12, the insertion hole 12 is formed with a height that is greater than that of the insertion portion 3 by the dimension k. A catch slot 12*a* is formed at the center of the lower wall of the insertion hole 12. A catch 13 for engaging with the claw 4*a* of the latch 4 is formed at the base of the catch slot 12a. The catch 13 has a slanted upper surface 13*a*.

To insert the handle 1 into the insertion hole 12, an operator holds the handle 1 by the grip 2 to give the handle 1 the posture shown in FIG. 2 relative to the main body 11. The operator then aligns the insertion portion 3 of the handle 1 with the insertion hole 12 and pushes the handle 1 in the direction j. The slanted surface 4*a* of the latch 4 will ride up the slanted surface 13*a* of the catch 13 as shown in FIG. 3. Pushing the handle 1 further in the direction j will cause the claw 4*a* of the latch 4 to ride over the catch 13. The latch 4 will then resiliently regain its natural shape so that the claw 4*a* hooks onto the catch 13 as shown in FIG. 4. At this point the handle 1 is attached to the main body 11.

The engagement of the latch 4 with the catch 13 prevents the handle 1 from slipping out of the insertion hole 12. The auxiliary handle 1 allows an operator to either operate the power tool with both hands, that is, with one hand holding the main handle and the other holding the auxiliary handle 1, or remove the auxiliary handle 1 and operate the power tool by holding the main handle only.

SUMMARY OF THE INVENTION

However, the difference in the height of the insertion portion 3 and the insertion hole 12 produces a gap k when the handle 1 is attached to the main body 11 as shown in FIG. 4. The gap k results in a loose fit of the handle 1 so that the handle 1 rattles in the vertical direction g by the amount k. Additionally, as shown in FIG. 5, when the handle 1 is pressed downward in the direction h, the handle 1 pivots in direction i on point L at the base of the insertion portion 3 as the fulcrum until the upper corner of the insertion portion 3 abuts points m, resulting in a pivotal rattling of the handle 1 to an extent at the tip of the grip 2 indicated by distance n. This unstable attachment of the handle 1 inhibits stable control of the power tool.

As shown in FIG. 6, increasing the length p of the insertion portion 3 that is inserted into the insertion hole 12 will reduce the degree of the rattling distance n. However, lengthening the insertion portion 3 does not completely solve the problems of pivotal and vertical rattling and also creates an additional problem in that the size of the resultant power tool must be increased to accommodate the longer insertion portion 3.

It is therefore, an object of the present invention to provide an improved power tool having an auxiliary handle detachable arrangement in which rattling of the auxiliary handle relative to a main body in a vertical direction after assembly can be obviated without increasing size of the insertion portion.

This and other objects of the present invention will be attained by providing a power tool including a main body formed with an auxiliary handle receiving portion, a main handle provided integrally with the main body, and an auxiliary handle having a grip portion and an insertion portion. The insertion portion extends from the grip portion and is detachably engageable with the handle receiving portion. The insertion portion has a resilient latch portion engageable with the insertion portion. The insertion portion has an upper surface and a lower arcuate surface. The arcuate surface is configured to have a vertical length at a base end of the insertion portion greater than a vertical length at a tip end portion thereof. The insertion hole has an upper surface engageable with the upper surface of the insertion portion and a lower surface engageable with the base end of the arcuate surface.

In a preferred embodiment, the upper surface of the insertion portion is provided with an upper protrusion extending in a widthwise direction of the insertion portion, and, the upper surface of the insertion hole has an upper indentation engageable with the upper protrusion. Further, an outer perimeter of the grip portion is larger than that of the insertion portion for providing a stepped portion and an upper corner therebetween. The lower arcuate surface of the insertion portion being defined by a radius defined between the upper corner and base end of the arcuate surface, so that a vertical height of the base portion of the insertion portion is maximum and a vertical height of the tip end portion thereof is minimum.

Furthermore, a distance between a top surface of the upper indentation and a lower surface of the insertion hole is equal to a vertical distance between a top of the upper protrusion and the base end of the lower arcuate surface.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENT

A power tool having a detachable arrangement for an auxiliary handle relative to a main body according to a preferred embodiment of the present invention will be described while referring to the accompanying drawings.

Figure 1:
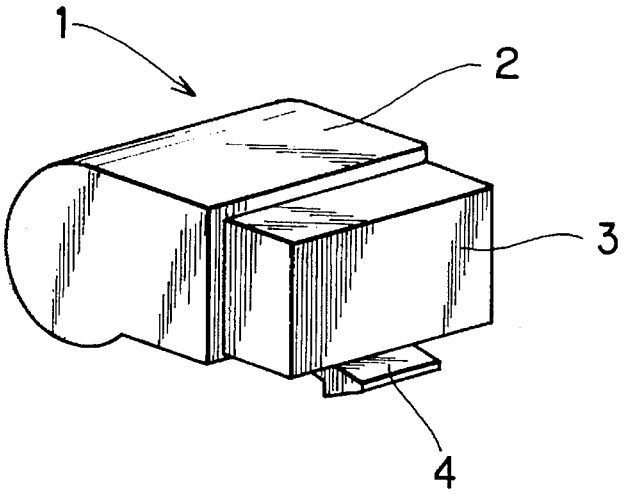
FIG. 1 PRIOR ART
FIG. 1 is a perspective view showing a conventional detachable auxiliary handle for a power tool.
Figure 2:
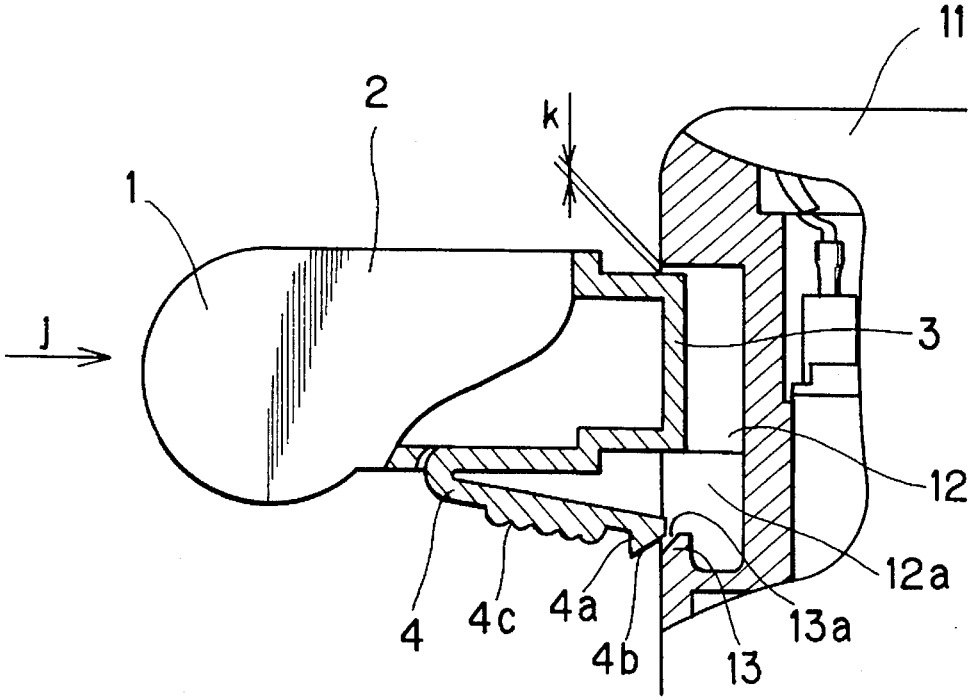
FIG. 2 PRIOR ART
FIG. 2 is a cross-sectional view showing the handle of FIG. 1 and a main body of the power tool with an insertion hole for receiving the handle.
Figure 3:
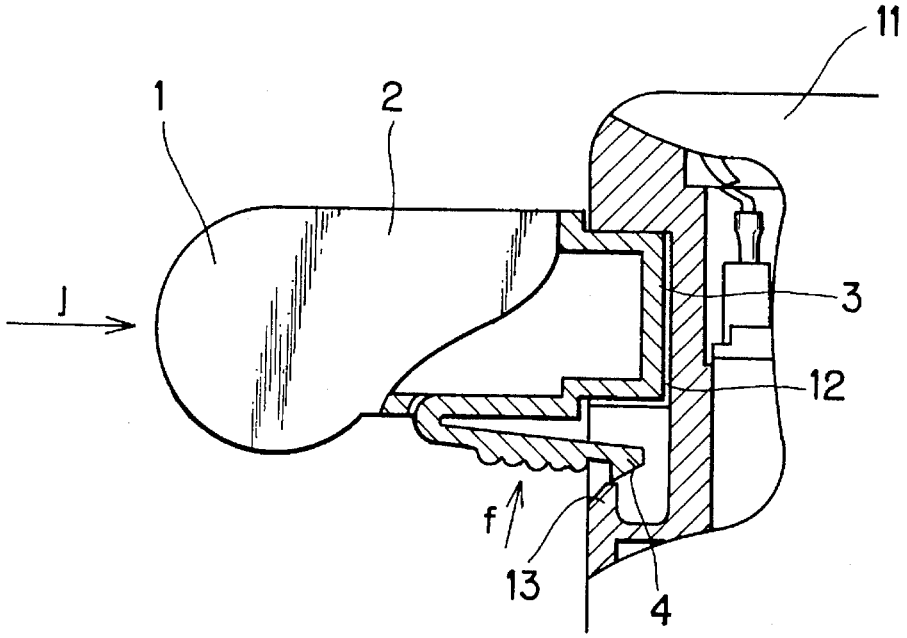
FIG. 3 PRIOR ART
FIG. 3 is a cross-sectional view showing the handle shown in FIG. 1 being inserted into the insertion hole shown in FIG. 2.
Figure 4:
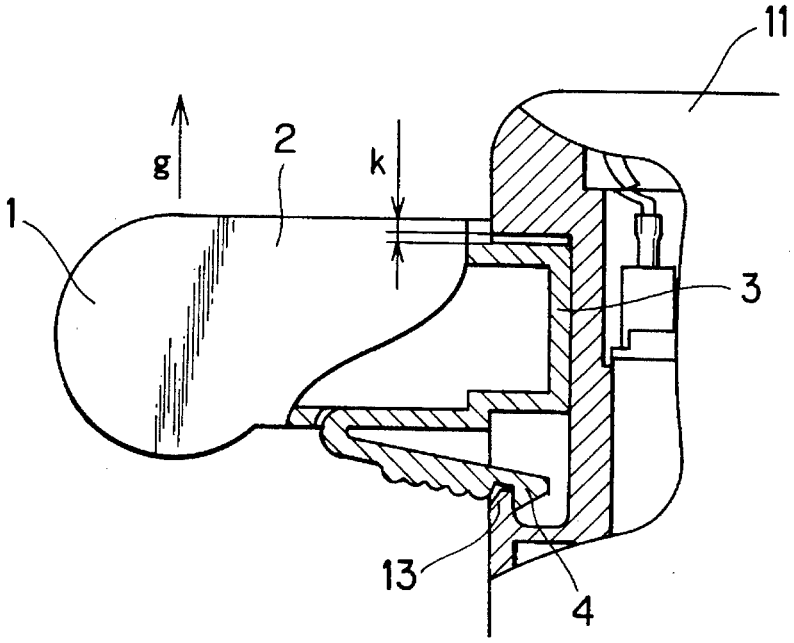
FIG. 4 PRIOR ART
FIG. 4 is a cross-sectional view showing the handle of FIG. 1 engaged in the insertion hole of FIG. 2.
Figure 5:
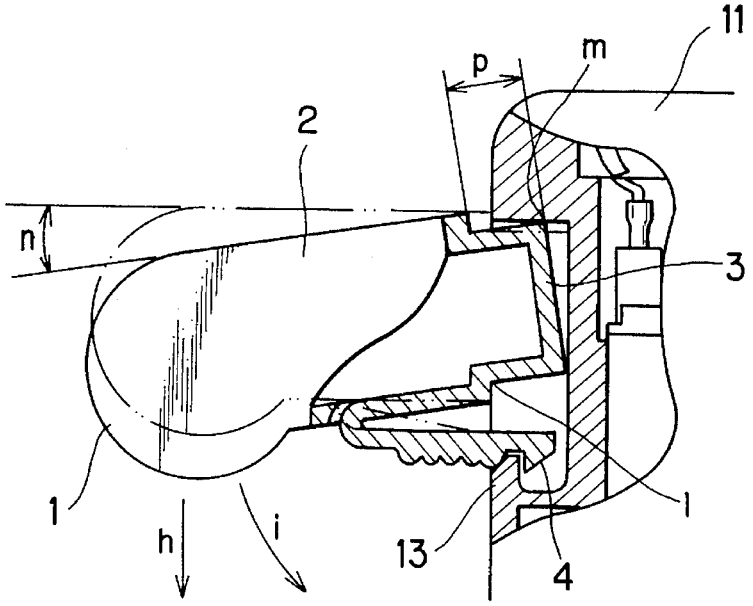
FIG. 5 PRIOR ART
FIG. 5 is a cross-sectional view showing the effects of a loose fit of the handle of FIG. 1 and the insertion hole of FIG. 2.
Figure 6:
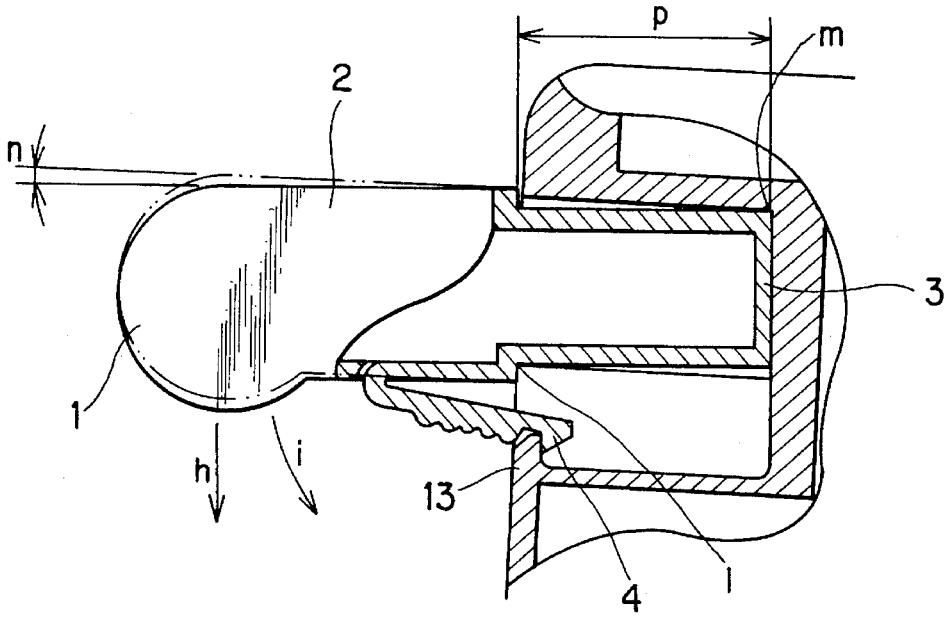
FIG. 6 PRIOR ART
FIG. 6 is a cross-sectional view showing a possible modification of the handle of FIG. 1 and the insertion hole of FIG. 2.
Figure 7:
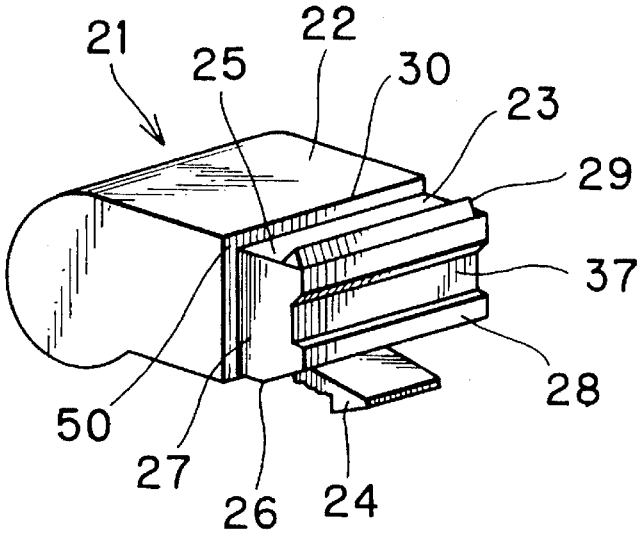
FIG. 7 is a perspective view showing a detachable auxiliary handle according to one embodiment of the present invention.
Figure 8:
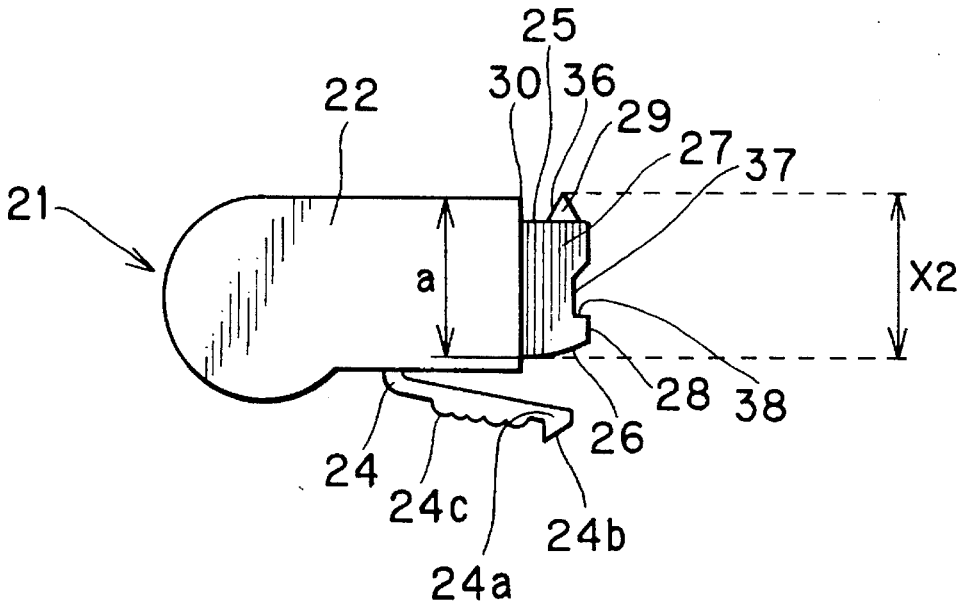
FIG. 8 is a side view showing the handle shown in FIG. 7.

FIGS. 7 and 8 show a detachable handle 21 according to the preferred embodiment. The handle 21 includes a grip 22, an insertion portion 23, and a latch 24. The outer perimeter of the grip 22 is larger than that of the insertion portion 23 so that a step 50 appears where the two connect. An elongated upper protrusion 29 having a slanted surface 36 is provided extending in the widthwise direction of the insertion portion 23 at the upper surface 25 of the insertion portion 23. The length of the upper protrusion 29 is slightly shorter than the width of the insertion portion 23. An elongated front indentation 37 having a flat lower surface 38 is provided extending in the widthwise direction at the front surface 28 of the insertion portion 23.

A curved or arcuate surface 26 is provided at the lower side of the insertion portion 23. The curve of the arcuate surface 26 is defined by an arc of an imaginary circle that has a radius equal to the height "a" of the grip 22 and that is centered on the upper corner 30 at the intersection of the step 50 and the upper surface of the grip 22. The latch 24 includes a ridged portion **24*c* and a claw 24*a* with a slanting surface 24*b***.

Figure 9:
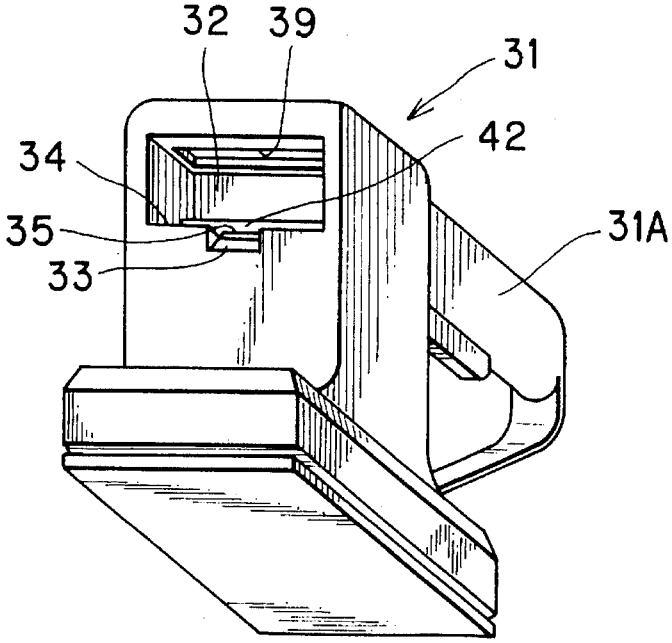
FIG. 9 is a perspective view showing a power tool with an insertion hole for receiving the handle according to the embodiment of this invention.

FIG. 9 shows a main body 31 of a power tool formed with an insertion hole 32 for receiving the insertion portion 23 of the handle 21. A main handle 31A is provided integrally with the main body 31. To facilitate insertion, the insertion hole 32 is formed with a width slightly greater than that of the insertion portion 23 of the handle 21. An elongated upper indentation 39 for receiving the upper protrusion 29 is provided extending in the widthwise direction in the roof of the insertion hole 32. The upper indentation 39 includes a slanted surface 41 facing the interior of the insertion hole 32. An elongated rear protrusion 42 for engaging with the front indentation 37 is provided extending in the widthwise direction in the vertical center of the rear wall of the insertion hole 32. The rear protrusion 42 is formed with a slanting upper surface, which will abut the upper surface of the front indentation 37, and a lower surface 43, which will abut with the lower surface 38 of the front indentation 37.

A distance X1 (FIG.10) between the surface of the upper indentation 39 and the lower surface 34 of the insertion hole 32 is equal to the vertical distance X2 (FIG. 8) between the top edge of the upper protrusion 29 and the lowermost portion of the insertion portion 23, i.e., the base end of the arcuate surface 26.

In the center of the lower surface 34 of the insertion hole 32 is formed a catch slot 35 for receiving the latch 24. A catch 33 for engaging the latch 24 is formed in the horizontal center of the lower surface 34 of the insertion hole 32. The catch 33 has a slanting front surface **33*a* for facilitating smooth entrance of the latch 24**.

Figure 10:
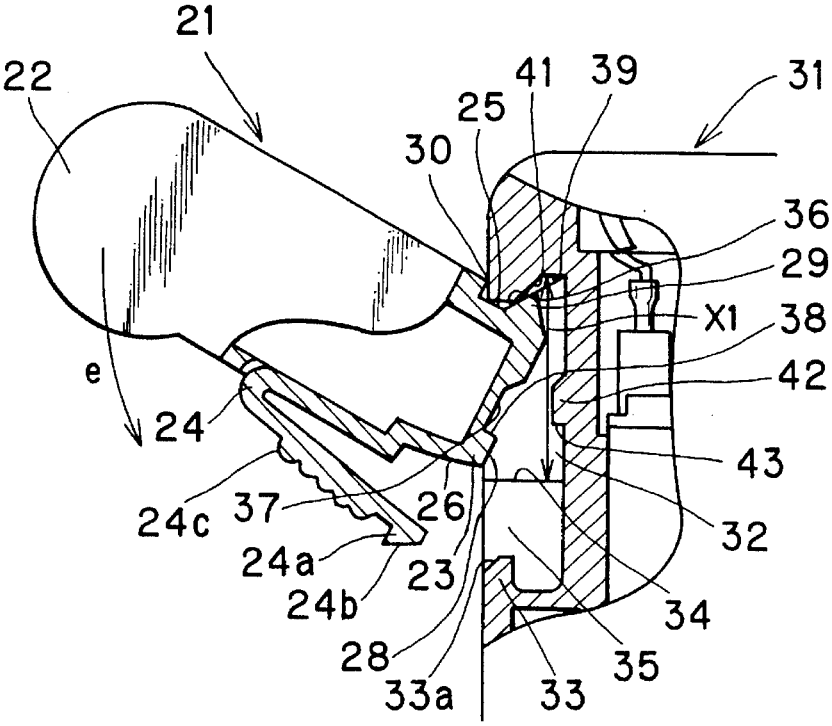
FIG. 10 is a cross-sectional view showing the handle of FIG. 7 posed for insertion into the insertion hole according to a handle detachable arrangement of the embodiment.
Figure 11:
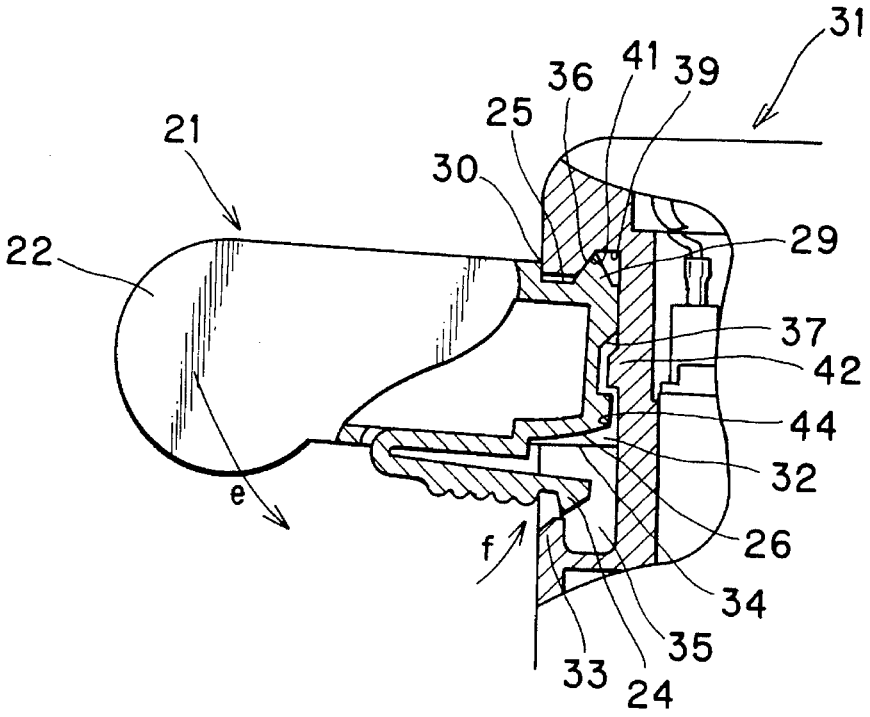
FIG. 11 is a cross-sectional view showing the handle of FIG. 7 being inserted into the insertion hole of FIG. 9 according to the handle detachable arrangement.
Figure 12:
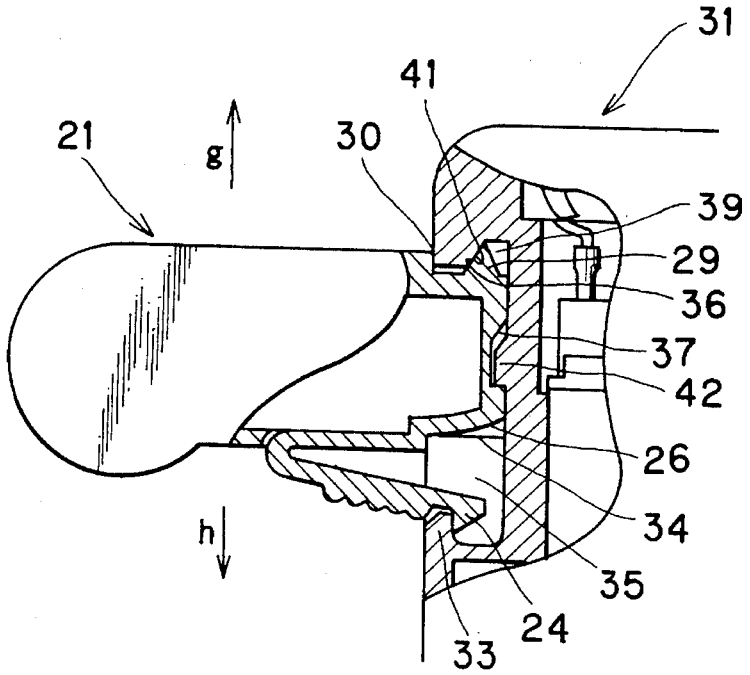
FIG. 12 is a cross-sectional view showing the handle of FIG. 7 completely engaged in the insertion hole of FIG. 9 according to the handle detachable arrangement of the illustrated embodiment.

Next, an explanation of how the handle 21 is attached to the main body 31 of the power tool will be provided while referring to FIGS. 10 through 12. To attach the handle 21 to the main body 31 of the power tool, an operator holds the grip 22 so that the handle 21 is tilted at an angle as shown in FIG. 10. The operator then inserts the upper protrusion 29 of the insertion portion 23 into the upper indentation 39 of the insertion hole 32 until the corner 30 abuts the main body 31 of the power tool.

The operator then pivots the handle 21 on the tip of the upper protrusion 29 in direction e so that the slanted surface **24*b* of the claw 24*a* abuts the slanted surface 33*a* of the catch 33. The curve of the curved surface 26 allows pivotally inserting the insertion portion 23 without the insertion portion 23 hitting against the lower surface 34 of the insertion hole 32**.

When the handle 21 is further pivoted in the direction e, the attachment latch 24 will resiliently deform so that the slanted surface **24*b* of the claw 24*a* slides up the slanted surface 33*a* as shown in FIG. 11. The claw 24*a* will ride over the catch 33, whereupon the attachment latch 24 regains its natural shape so that the claw 24*a* hooks onto the catch 33 as shown in FIG. 12. At this point the handle 21 is attached to the main body 31. The front indentation 37 of the handle 21 is engaged with the rear protrusion 42 of the insertion hole 32, the slanted surface 36 of the upper protrusion 29 is in abutment contact with the slanted surface 41 at the upper side of the insertion hole 32, and the lower surface 38 of the indentation 37 is in abutment contact with the lower surface 43 of the rear protrusion 42**.

In the complete assembly of the auxiliary handle 21 to the insertion hole 32, the distance X1 between the surface of the upper indentation 39 and the lower surface 34 of the insertion hole 32 is equal to the vertical distance X2 between the top edge of the upper protrusion 29 and the lowermost portion of the insertion portion 23, i.e., the base end of the arcuate surface 26. Therefore, rattling of the auxiliary handle 21 in the vertical direction with respect to the main body 31 of the power tool does not occur.

Further, engagement of the latch 24 with the catch 33 and abutment contact of the upper protrusion 29 and the slanted surface 41 prevent the handle 21 from moving vertically in relation to the main body 31 of the power tool, i.e., in the direction g. Abutment contact between the base of the curved surface 26 and the lower surface 34 of the insertion hole 32 and between the front surface 28 of the insertion portion and the rear surface of the insertion hole 32 prevents the handle 21 from moving pivotally in relation to the main body 31 of the power tool, i.e., in the direction h. In this way, the handle 21 according to the present invention is securely fixed in the insertion hole 32 of the main body 31.

To detach the handle 21 from the main body 31, the operator presses the ridged portion **24*c* upward to deform the latch 24 until the claw 24***a* rises higher than the upper tip of the catch 33. The operator can then pull the handle 21 out of the insertion hole 32 by pivoting the handle 21 in the opposite direction to that during insertion.

While the invention has been described in detail with reference to specific embodiments thereof, it would be apparent to those skilled in the art that various changes and modifications may be made therein without departing from the spirit and scope of the invention.

What is claimed is:

1. A power tool including a main body formed with an auxiliary handle receiving portion which comprises an insertion hole;

a main handle provided integrally with the main body;

an auxiliary handle having a grip portion and an insertion portion extending from the grip portion and detachably engageable with the handle receiving portion, the insertion portion having a resilient latch portion; and, the improvement comprising:

the insertion portion (23) having an upper surface (25) and a lower arcuate surface (26) configured to have a vertical length at a base end of the insertion portion greater than a vertical length at a tip end portion thereof; and the insertion hole (32) having an upper surface operative to engage with the upper surface (25) of the insertion portion and a lower surface (34) operative to engage with the base end of the lower arcuate surface (26), the upper surface (25) of the insertion portion (23) being provided with an upper protrusion (29) extending in a widthwise direction of the insertion portion, and the upper surface of the insertion hole (32) having an upper indentation (39) operative to engage with the upper protrusion (29), wherein an outer perimeter of the grip portion (22) is larger than that of the insertion portion (23) for providing a stepped portion (50) and upper corner (30) therebetween, the lower arcuate surface of the insertion portion being defined by a radius defined between the upper corner and base end of the lower arcuate surface, so that a vertical height of the base portion of the insertion portion is a maximum and a vertical height of the tip end portion thereof is a minimum; and further wherein a distance (X1) between a top surface of the upper indentation (39) and a lower surface (34) of the insertion hole is equal to a vertical distance (X2) between a top of the upper protrusion (29) and the base end of the lower arcuate surface (26).

2. The power tool as claimed in claim 1, wherein the tip end of the insertion portion (23) has a tip end surface (28) formed with a front indentation (37), and the insertion hole (32) has a bottom wall provided with a rear protrusion (42) operative to engage with the front indentation (37).

3. The power tool as claimed in claim 2, wherein the insertion hole (32) is formed with a catch slot (35) contiguous with the lower surface (34) of the insertion hole (32), the resilient latch portion (24) being engageable with the catch slot.

4. A power tool including a main body formed with an auxiliary handle receiving portion which comprises an insertion hole;

a main handle provided integrally with the main body;

an auxiliary handle having a grip portion and an insertion portion extending from the grip portion and detachably engageable with the auxiliary handle receiving portion, the insertion portion having a resilient latch portion; and, the improvement comprising:

the insertion portion (23) having an upper surface (25) and a lower arcuate surface (26) configured to have a vertical length at a base end of the insertion portion greater than a vertical length at a tip end portion thereof; and the insertion hole (32) having an upper surface operative to engage with the upper surface (25) of the insertion portion and a lower surface (34) operative to engage with the base end of the lower arcuate surface (26), wherein the upper surface (25) of the insertion portion (23) is provided with an upper protrusion (29) extending in a widthwise direction of the insertion portion, and wherein the upper surface of the insertion hole (32) has an upper indention (39) operative to engage with the upper protrusion (29), and further wherein the tip end of the insertion portion (23) has a tip end surface (28) formed with a front indentation (37), and the insertion hole (32) has a bottom wall provided with a rear protrusion (42) operative to engage with the front indentation (37).

* * * * *